United States Patent [19]

Bright et al.

[11] 4,072,129

[45] Feb. 7, 1978

[54] ELECTROSTATIC POWDER DEPOSITION

[75] Inventors: Alfred William Bright, Southampton, England; Michael Anthony Mersham Overton, Stavanger, Norway; Ian Frederick Parker, Fareham, England

[73] Assignee: National Research Development Corporation, London, England

[21] Appl. No.: 680,878

[22] Filed: Apr. 27, 1976

[51] Int. Cl.[2] ..... B05B 5/02

[52] U.S. Cl. ..... 118/629; 239/15

[58] Field of Search ..... 118/DIG. 5, 629, 300, 118/308, 627, 630–635; 239/3, 15; 317/3, 262

[56] References Cited

U.S. PATENT DOCUMENTS

| | | | |
|---|---|---|---|
| 2,877,137 | 3/1959 | Juvinall et al. | 118/630 X |
| 3,691,991 | 9/1972 | Luderer et al. | 118/629 |
| 3,901,184 | 8/1975 | Payne et al. | 118/629 |
| 3,905,330 | 9/1975 | Coffee | 118/629 |

FOREIGN PATENT DOCUMENTS

| | | | |
|---|---|---|---|
| 842,137 | 5/1970 | Canada | 118/629 |
| 2,129,470 | 10/1972 | France | 118/629 |
| 2,203,351 | 8/1973 | Germany | 118/629 |
| 2,451,514 | 5/1975 | Germany | 118/629 |
| 1,375,928 | 12/1974 | United Kingdom | 118/629 |
| 1,228,755 | 4/1971 | United Kingdom | 118/634 |
| 1,283,880 | 8/1972 | United Kingdom | 118/634 |
| 1,284,757 | 8/1972 | United Kingdom | 118/634 |
| 1,351,944 | 5/1974 | United Kingdom | 118/634 |
| 1,329,574 | 9/1973 | United Kingdom | 118/634 |

*Primary Examiner*—Louis K. Rimrodt

*Attorney, Agent, or Firm*—Cushman, Darby & Cushman

[57] ABSTRACT

Powder to be deposited electrostatically by spraying from a nozzle is charged tribo-electrically. The powder is admitted at a controlled rate to a housing through which an air stream is caused to flow and becomes charged by frictional impact with the surface of a rotor which intercepts the air stream. Charged powder suspended in the air stream passes through a conduit to the nozzle at which a baffle is located to cause the powder to be sprayed in a predetermined distribution.

10 Claims, 8 Drawing Figures

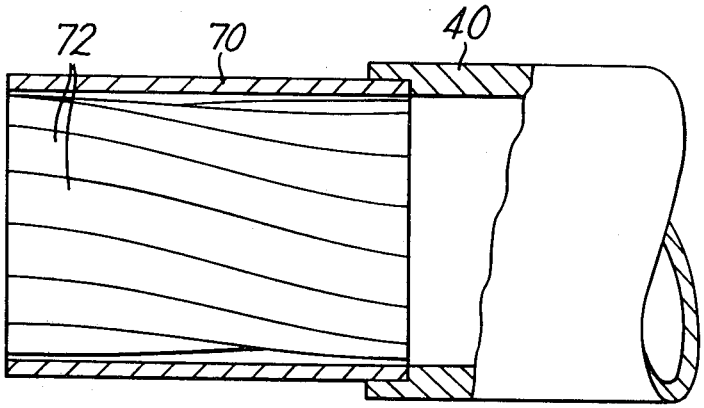
Fig. 3
Fig. 4
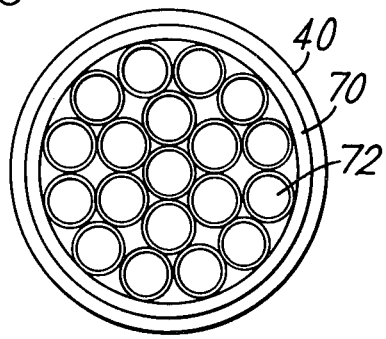

Fig. 5
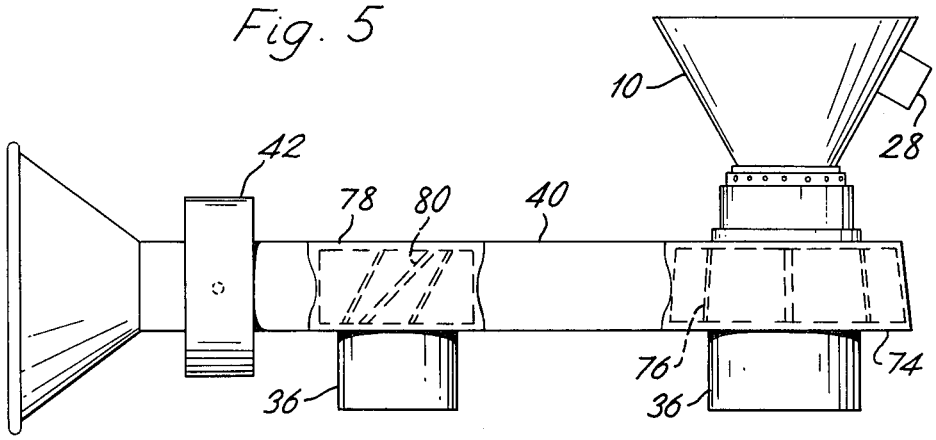
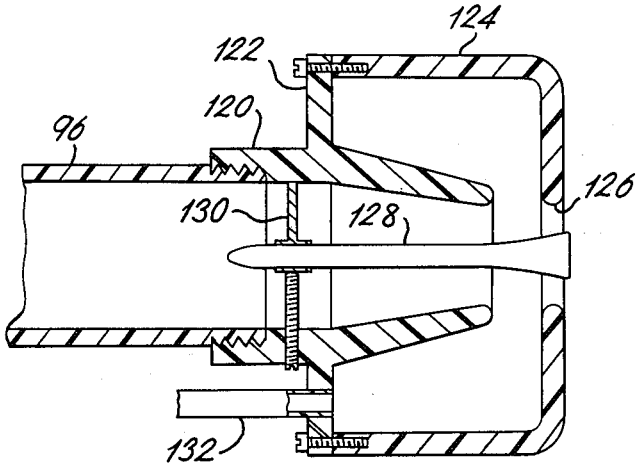
Fig. 8

ELECTROSTATIC POWDER DEPOSITION

This invention relates to the electrostatic deposition of powder and more particularly to apparatus for electrostatically depositing powder which has been charged by tribo electrification.

In conventional electrostatic powder deposition apparatus, a high voltage generator is required to maintain an output electrode at a high potential. Where tribo electric charging is used, the need for such a high voltage generator can be avoided.

Electrostatic powder deposition apparatus has been proposed in which powder is circulated in a tube forming a closed circuit. As a result of tribo electric charging on contact between the powder and the walls of the tube an electrode becomes charged to a high voltage and an electric field is established between the electrode and an earthed object to be coated. Some powder is allowed to escape from the tube and this is electrostatically deposited on the earthed object. A disadvantage of this apparatus is that only a relatively small percentage of the powder is being applied at one time while a relatively large amount of powder must constantly be recirculated in the tube. There is a tendency for this powder to agglomerate, causing an increase in particle radius and thus a decrease in charge/mass ratio and a consequent degradation of performance. In addition, the relatively large volume of powder in the tube makes it difficult to clean the apparatus and to recharge rapidly with fresh powder of a different sort or colour. Moreover, it is difficult to control the rate at which powder is deposited independently of the rate of charging. It is an object of the present invention to provide apparatus in which these disadvantages are overcome.

According to the present invention, apparatus for electrostatically depositing powder comprises a housing, means for enabling powder to be fed into the housing, means for producing a stream of air through the housing, a charging rotor contained within the housing having a number of blades, each blade being rotatable to intercept the stream of air and having a surface so disposed and constructed of such material as to cause powder suspended in the air stream to become charged by tribo electrification on collision with that surface, and a conduit for conveying the charged powder suspended in the stream of air from the charging motor to a powder output nozzle, the housing and the conduit having inner surfaces of material such that no appreciable loss of charge from the powder occurs on contact with those surfaces.

The charging rotor may also be effective to produce the stream of air through the housing.

The material of the inner surface of the housing may be such as to cause additional charging of the powder on collision with the surface.

Means for establishing an electric field in space between the powder output nozzle and an object to be coated with powder may comprise an electrode which is charged to a high potential by the powder. Alternatively, the powder may be discharged through a nozzle of insulating material, the required field being provided by the space charge of the powder.

Embodiments of the invention will now be described, by way of example, with reference to the accompanying drawings, in which:

FIG. 3 is a partially broken away side view of an outlet nozzle in accordance with another embodiment of the invention;

FIG. 4 is an end view of the nozzle shown in FIG. 3;

FIG. 5 is a diagrammatic representation of a further modification of the embodiment shown in FIG. 1;

FIG. 8 is a diagrammatic representation of a modified outlet nozzle for use in the embodiment of FIG. 1 or FIG. 5 or FIG. 6.

Figure 1:
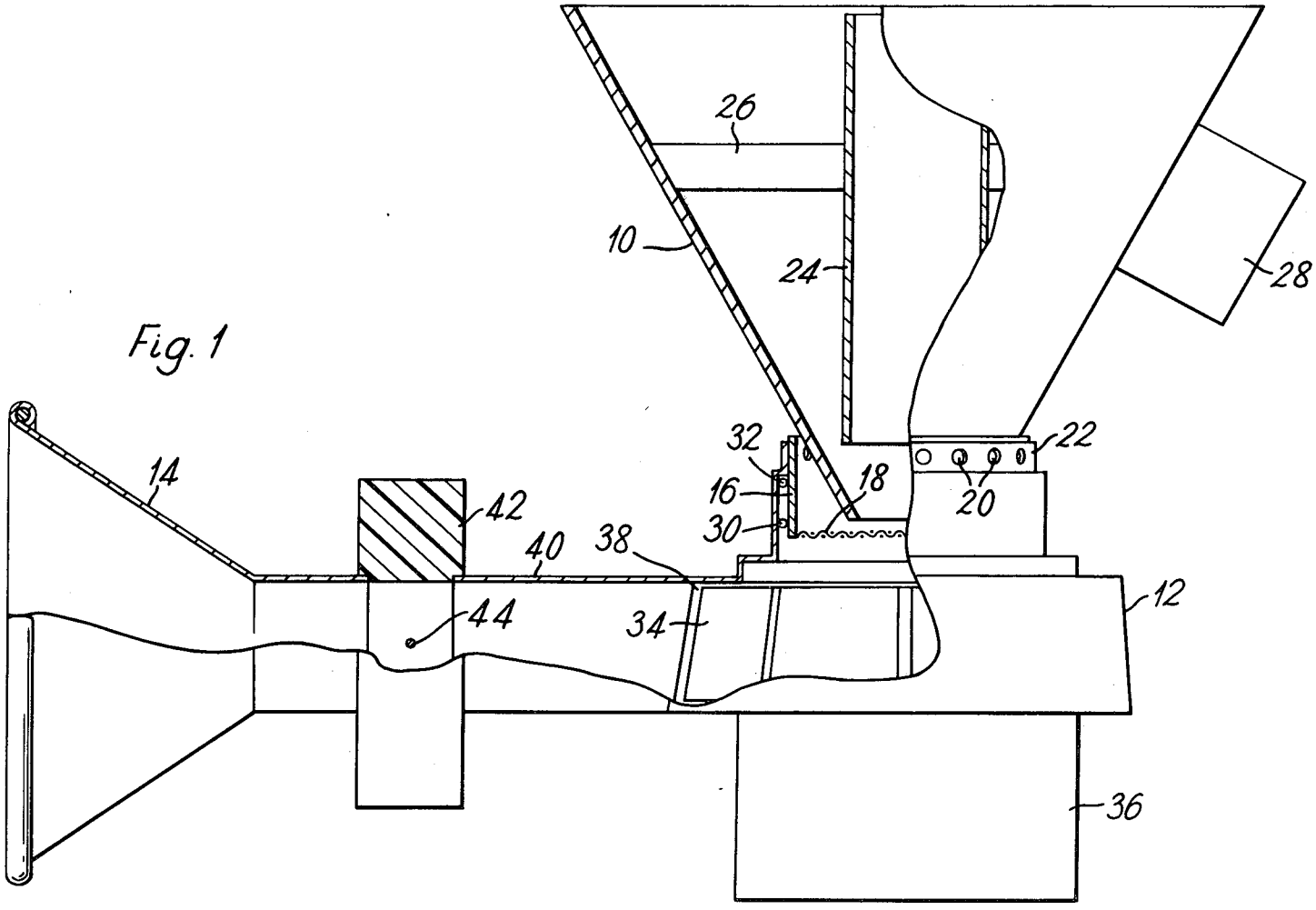
FIG. 1 is a partially broken away side view of an embodiment of the invention.

The powder deposition apparatus shown in FIG. 1 consists basically of a powder hopper 10 for feeding uncharged powder to a fan 12 which blows the powder stream out through a conical metallic nozzle 14.

The hopper 10 is generally conical and has its lower end projecting into a chamber 16 the bottom of which is closed by a wire mesh sieve 18 which may have holes about 250μ wide. Above the level of the bottom of the hopper 10, the chamber 16 has a series of inlet holes 20 which can be covered in whole or in part by a collar 22 containing corresponding holes so as to form a variable air intake. The hopper 10 also has a central air inlet tube 24 mounted on a spider 26. A vibrator 28 is mounted on the outside of the hopper 10. The entire assembly formed by the hopper 10 and chamber 16 is mounted on the rest of the apparatus by means of bearings 30 and 32 so as to be free to vibrate.

Thus, in use, the powder which passes through the sieve is in a fluidised state, any agglomerates of powder being retained by the sieve 18. The variable air intake formed by the holes 20 and the collar 22 enables the air/powder ratio, and thus the density of the cloud of sprayed powder, to be controlled.

The fluidised powder from the sieve 18 falls on to the rotor 34 of the fan 12 which is powered by an electric motor 36. Inside the fan 12, the powder receives a large number of impacts with the fan rotor 34 and the inner lining 38 of the housing of the fan. The powder acquires a charge by a tribo electric mechanism during these impacts. The advantages of the invention derive partly from the high efficiency of the charging process in which the blades of the fan rotor 34 provide during rotation a very large effective area in addition to the housing surface for contact with the powder particles. By comparison, in known arrangements in which powder is blown over static contact surfaces, the effective contact area per unit time is much smaller.

The material of the fan rotor 34 and the lining 38 is chosen to give the maximum stable charge for a particular powder during extended operation. Excessive charge may cause electrical breakdown and is to be avoided, for example by using when necessary a lining material which produces little or no additional charge. In general however the values of tribo-electric work function for the materials of the rotor and the lining should differ as widely as possible from that of the powder. Ideally the surface material of the rotor should also be capable of charge replenishment (or leakage) to prevent the accumulation of a layer of charge which would repel the partly charged powder.

The fan 12 of FIG. 1 is so constructed that the rotor 34 and the lining 38 can readily be changed so that the most suitable surface material for use with a particular powder can be found by experiment. Thus it is preferred that for powders such as epoxy resins the surfaces of the rotor 20 and of the housing 22 should be coated with nylon or with polytetrafluoroethylene; for nylon powder uncoated aluminium or other metallic surfaces are suitable. Resin powders cause difficulty because they may be used in a partly-cured state and are then liable to fuse to otherwise suitable charging surfaces on high-speed impact. It has been found however that fusion is unlikely to occur at a nylon surface even after the rise in temperature within the fan which accompanies an extended period of operation. The level of charge built up increases with rotor speed but overheating and aggregation of the powder occurs if the speed is too high. A typical upper speed for epoxy resin powder would be 3000 to 4000 r.p.m. Aggregation of particles of powder reduces the charge to mass ratio which can be achieved and the present experimental values in the order of $10^{-3}$C/kg relate to powders of discrete particles in the size range of a few tens of microns.

The fan rotor 34 blows the fluidised charged powder down an outlet tube 40 which may conveniently be metallic but is not necessarily so. The tube 40, if metallic, is connected by an insulating section 42 to an output nozzle 14 of electrically conductive material. Contact of some of the charged powder with the metallic nozzle 14 charges it to a high voltage so that it serves as an electrode to establish an electric field between the apparatus and any object which is to be coated by the powder. Such objects to be coated are earthed.

The length of the insulating section 42 merely needs to be sufficient to provide adequate insulation between the high voltage output nozzle 14 and the tube 40 when this is metallic. The resistivity of the material of which it is made should be as high as possible to minimise leakage currents and suitable materials for this purpose are nylon, polytetrafluoroethylene, methacrylates and epoxy resins. An earthed electrode such as a wire 44 exposed inside the insulating section 42 is desirable to avoid the build-up of charge on the insulating surface.

Figure 2:
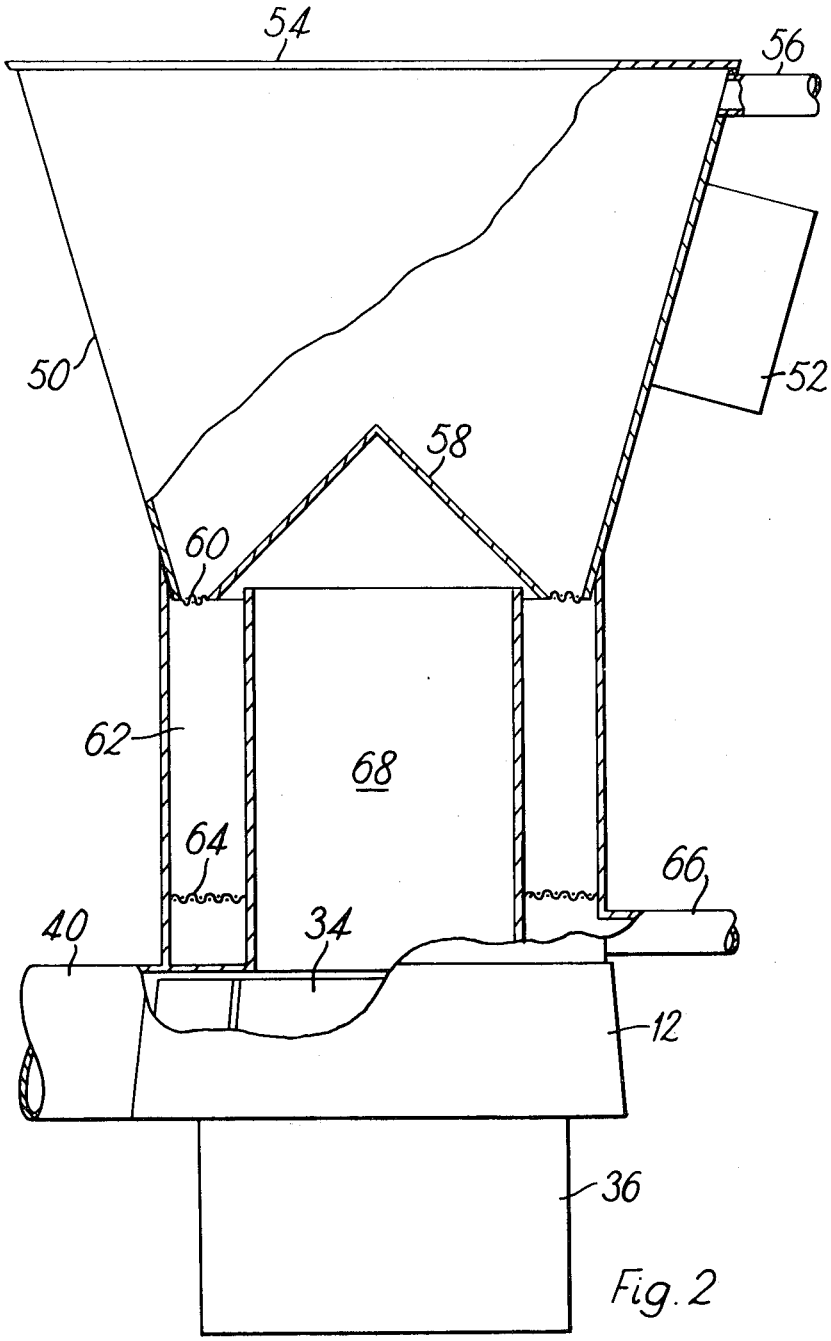
FIG. 2 is a partially broken away side view illustrating a modification of the embodiment shown in FIG. 1.

One factor which can cause degradation of performance of electrostatic powder spray apparatus is moisture in the powder and FIG. 2 illustrates a modified form of the apparatus shown in FIG. 1 incorporating provision for drying the powder. The fan 12 is similar to that shown in FIG. 1 and is connected in the same way to an outlet nozzle (not shown) as illustrated in FIG. 1. Consequently, these parts of the apparatus will not be described in detail. The hopper 50 has a vibrator 52 mounted thereon but differs from the hopper 10 of the apparatus shown in FIG. 1 in that it is closed at the top by means of a cap 54. A pipe 56 is provided for blowing hot air into the top of the hopper. The hopper 50 has an upwardly pointed conical base 58 which is separated from the side walls thereof by an annular wire mesh 60. The mesh 60 allows communication between the hopper 50 and an annular chamber 62 which is divided into an upper and a lower portion by an annular wire mesh 64. An inner pipe 66 is provided to enable hot air to be blown into the chamber 62 below the mesh 64. The upward current of hot air in the chamber 62 entrains powder which falls through the mesh 60 and carries it into the space below the conical bottom 58 of the hopper whence it falls through the region 68 bounded by the inner walls of the annular chamber 62 on to the fan 12. Thereafter, the apparatus operates in the same way as the apparatus shown in FIG. 1.

The drying process must be controlled according to the nature of the material and the humidity conditions under which the powder is stored to yield a resistivity in a range intermediate between the highest and lowest values. The tribo-electric charging mechanism becomes less effective as the surface of a high-resistivity powder is made very dry or as the temperature of dry powder is raised so that its bulk resistivity falls.

As an alternative to using metal for the nozzle 14 a composite material having resistivity in the range $10^7$ to $10^9$ ohm-meters can be used. Such a material can be produced by mixing a polymer such as epoxy resin powder with a low conductivity powder such as glass or carbon. When a high potential is generated at a nozzle the risk arises of a dust explosion caused by a high energy spark; the use of a spray nozzle 14 formed from such a low resistivity material reduces this risk.

Referring to FIGS. 3 and 4, with either the embodiment illustrated in FIG. 1 or the embodiment illustrated in FIG. 2, it is possible to replace the nozzle 14 with a nozzle 70 made from a substantially insulating material. The nozzle 70 is attached directly to the fan outlet tube 40, no intervening insulating tube being required. In order to obtain a uniform jet of powder the nozzle 70 is filled with a number of tubes 72 of a material such as nylon of internal diameter about 3 millimeters and length about two centimeters. The tubes 72 are preferably skewed relative to the axis of the nozzle 70 so as to give a rotary motion to the emerging powder thereby rendering spatial distribution of powder more uniform. It is believed that the required electric field between the apparatus and an object to be coated with powder is established by the space charge of the relatively dense powder stream that emerges from the nozzle 70. The effect of such a field is to allow penetration of the powder into spaces which would be electrically screened from a field acting directly between the nozzle and the object. Conventional high-voltage coating systems suffer from this screening defect and also from roughening of the deposited powder surface due to a reverse ion current phenomenon. In the tribo-electric system there is no flow of ion current and a much smoother surface of greater thickness can be obtained. An insulating material for use as a nozzle should preferably have slight conductivity, as is characteristic of nylon, to prevent the accumulation of surface charge. An earthed electrode such as the wire 44 is also desirable at the inner end of the nozzle for the same purpose.

Alternative methods may be used for supplying powder from the hopper 10 (FIG. 1) or 50 (FIG. 2) to the fan 12. For example a powder pump comprising a helical screw in a cylindrical chamber may be used to convey powder at a predetermined rate proportional to the rate of rotation of the screw. A separate air inlet is required.

In another form of powder pump having a parallel-finned rotor, rotated about a horizontal axis, the volume of powder loaded between adjacent fins can be varied according to the position of wedges which slide between the fins. By this means the density of the powder cloud can be varied.

In the embodiments described with reference to FIGS. 1 and 2 the fan 12 performs the dual function of blowing a stream of air through the housing and the tube 40 and of causing tribo-electric charging in the powder suspended in the air stream. It will be apparent that the two functions can be performed by separate means and that this may be advantageous since a single rotor structure although satisfactory in operation cannot in general be optimised for both purposes. In FIG. 5 an arrangement similar to that of FIG. 1 is illustrated schematically, the fan 12 being replaced by a fan 74 having a rotor 76 which has the sole function of generating an air stream. The rotor 76 has a conventional blade configuration which is efficient for this purpose. The housing 40 is extended to accommodate a fan 78 which receives the air stream carrying suspended powder from the fan 74. The fan 78 has a rotor 80 in which the blades are inclined at a comparatively small angle, typically in the range 15° to 25°, to the direction of rotation. The rotor 80 therefore has only a limited impulsive action on the air stream but provides many deflecting collisions with the suspended powder particles. The charging efficiency is thereby improved and a further advantage relates to the risk, to which reference was made earlier in this specification, that partly-cured resin powder may adhere to the rotor as a result of the heat generated on impact. By avoiding collisions at normal incidence in which much of the particle energy is converted to heat, the occurrence of thermal adhesion between a particle and the rotor surface is greatly reduced. The fans 74 and 78 have independently controllable drive motors 36.

Figure 6:
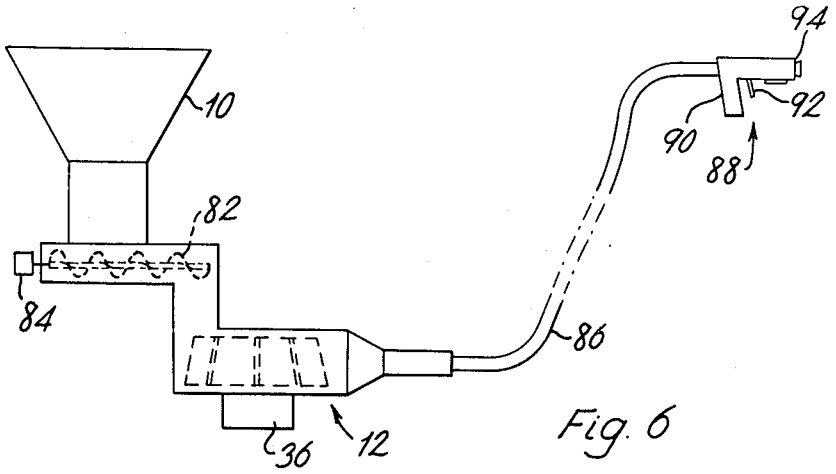
FIG. 6 is a diagrammatic representation of a further embodiment of the invention.
Figure 7:
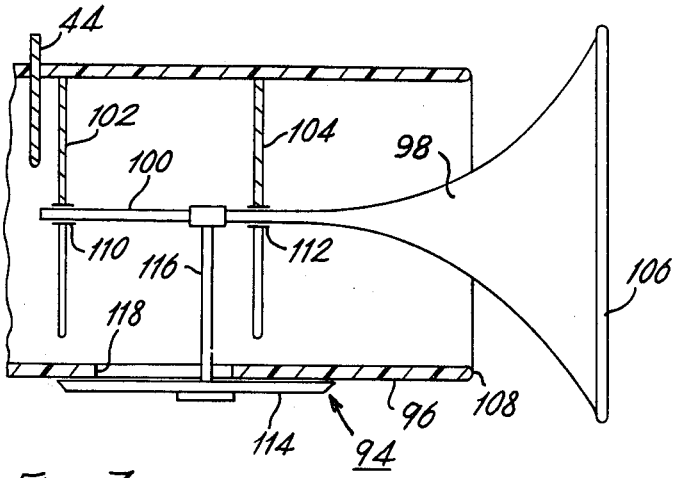
FIG. 7 is a diagrammatic representation of an outlet nozzle for use in the embodiment of FIG. 6.

In the further embodiments of FIGS. 6 and 7 further consideration is given both to the problem of achieving the maximum charge on the powder at the nozzle of spraying apparatus and to that of controlling the distribution of the spray.

The powder deposition apparatus of FIG. 6 comprises a powder hopper 10 from which powder is fed to a fan 12 driven by a motor 36 which blows the powder stream along a delivery tube 86 to a gun 88. The delivery tube 86 is made sufficiently long and flexible for the gun 88 to be hand-directed at a position remote from the powder supply. The fan 12 and hopper 10, which includes vibratory and drying arrangements to ensure that the powder flows freely, are as described with reference to FIG. 1 or FIG. 2. Reference was also made to the use of a helical-screw powder pump as the means of feeding powder to the fan 12 and such a pump 82 is shown driven by a motor 84.

The delivery tube 86 is required to convey the charged powder from the fan 12 without dissipating the charge but has no charging function in itself. A non-conducting rubber is a suitable material for the tube 86 which can be made of convenient length for hand-control of the gun 88. A handgrip 90 and trigger 92 are shown but any convenient form of location and control might be used. The trigger 92 forms a switch for the operation via control connections (not shown) of the fan 12 and pump 82. The gun 88 has a nozzle 94 of a form which tends to augment the charge carried by the powder and also may be designed to produce a powder cloud of particular distribution and may be adjusted during operation to vary that distribution.

FIG. 7 shows details of the nozzle 94 which principally comprises a cylindrical barrel 96 and a baffle 98. The baffle 98 is basically of conical form and is mounted with its axis on the axis of the barrel 96 and with its apex directed into the barrel 96. The baffle 98 is carried by a thin rod 100 extending axially within the barrel 96 from the apex and supported by spiders 102, 104 which lie in diametrical planes of the barrel 96 and are attached to its wall. The base 106 of the baffle 98 is normally of a diameter similar to or greater than the internal diameter of the barrel 96 and lies outside the mouth 108 of the barrel 96. The axial position of the baffle 98 can be adjusted during operation if required, by sliding the rod 100 through respective central mounting holes 110, 112 in spiders 102, 104. For this purpose a slide 114, movable longitudinally on the external surface of the barrel 96, carries a link 116 which passes through a longitudinal slot 118, through the wall of the barrel 96, and is attached to the rod 100. The slide 114 is so arranged that when it is operated the slot 118 remains sealed to prevent any escape of powder from the barrel through the slot 118. It is preferred to avoid discontinuities in the sectional profile of the baffle 98 and the basic conical form is modified at least by smoothing the transitions from the conical surface into the surface of the rod 100 and into the plane of the base 106. The modification of the conical surface may be extended so that a continuous concave or cusp-like profile is profile is produced. The base 106 of the baffle 98 is radiused at its periphery to prevent the build-up of large field gradients in this region.

In the operation of powder guns of known form it is commonly found to be difficult to produce a desired distribution of spray for a particular application. The use of a nozzle of the kind described greatly eases this difficulty. It will be apparent that the choice of a baffle of a particular base diameter and conical angle will determine a range of spray behaviour for a particular powder and rate of air flow and that the point of operation within this range will then depend on the axial positioning of the baffle. By moving the baffle progressively further from the mouth of the barrel the spray may be varied from the widely diffused powder cloud which is desirable for the uniform coating of a panel of large area to the more concentrated directional spray necessary for smaller articles. The cloud formation is due to the turbulence caused in the flow of powder when it strikes the baffle and therefore becomes more effective as the apex angle of the baffle is increased within a useful range. The baffle will generally be positioned so that the flow cross-section is not substantially impeded but in order to achieve a spray of restricted angle the baffle may be made with a small apex angle and small base diameter so that it can be located inside the mouth of the barrel.

In the region of turbulent flow large numbers of powder particles will collide with the baffle and some may do so repeatedly. If the components of the nozzle including the baffle are made from the material such as nylon a further advantage is derived for suitable powders in that the quantity of charge carried by the powder is augmented. Nylon is a particularly suitable material because it has slight conductivity sufficient to allow the replenishment of charge removed from its surface by the powder. Some highly insulating materials such as acrylics or polytetrafluoroethylene which are otherwise suitable as nozzle or baffle materials can be used if a surface discharge route is provided by means of an earthed electrode 44. The electrode 44 was discussed with reference to FIG. 1 and in the embodiment of FIG. 7 could be located for example in the region of the trigger 98 to avoid interference with the powder charge level at the mouth of the nozzle 96.

The baffle has been described with reference to FIGS. 6 and 7 as of conical form but the charge augmentation function would generally be fulfilled by planar or other forms of baffle; a particular directional distribution of powder would be characteristic of each form and would be selected as advantageous in an appropriate application.

In some applications, particularly those involving deposition within a hollow article, the rate of air flow which is satisfactory in open applications proves excessive in an enclosure. A modified low-pressure nozzle has been devised which is suitable for use with the charging system of the apparatus of FIG. 1, 5 or 6. FIG. 8 shows the construction of the nozzle in which a tubular extension piece 120 is adapted at one end to fit, for example, the diameter of the barrel 96 of FIG. 7 and is tapered towards the other end. The extension piece 120 carries an external annular flange 122 which in turn carries a cylindrical shell 124 having an end face with a central aperture 126. The end face of the shell 124 lies slightly in front of the outer end of the extension piece 120 and the aperture 126 is of similar diameter to the end opening of the extension piece 120. A baffle 128 is mounted by a spider 130 on the axis of the extension piece 120 and is flared only slightly at its outer end which lies within the diameter of the aperture 126. A pipe 132 is sealed at one end into a hole through the flange 122 and connected at the other end to an inlet for the fan 12 of FIG. 1 or FIG. 6 or the fan 74 of FIG. 5. In operation air contained in the annular volume enclosed between the shell 124 and the extension piece 120 is continuously extracted through the pipe 132 and is replaced by air from the main stream. The volume of air flowing outwards through the annular jet in the aperture 126 is therefore much reduced and the deposition quality is improved. The relative dimensions of the outward flow path and the path via pipe 132 are experimentally determined to produce the desired reduction in flow without introducing excessive disturbance in the flow of powder. Any powder which is drawn into pipe 132 is returned to the charging system at the fan input.

It will be apparent that although embodiments of systems effective for spraying powder have been described with reference to the relevant drawings as including particular means for carrying out the operations of feeding powder, producing an air stream, charging the powder and directing the charged powder to form a spray, these means are not exclusive to the respective embodiments. It is intended that the systems described should be illustrative only of the combinations of means which may be appropriate in particular cases.

We claim:

1. Apparatus for electrostatically depositing powder on an object comprising:

a housing;

means for producing a stream of air through said housing;

means for admitting powder to said housing at a predetermined rate and means for admitting air at a selectable rate for admixture with said powder to produce a predetermined density of suspension of said powder in said stream of air;

charging means contained within said housing including a rotor having a number of blades, each blade being adapted to intercept said stream of air on rotation of the rotor the blades and the housing having surface so disposed and constructed of such material as to cause triboelectric charging of the powder suspended in said stream of air on impact of said powder with said surfaces, said charging being sufficient to enable electrostatic deposition to be carried out under the influence of the electric field arising from such charge;

conduit means for conveying said stream of air from said charging means to a powder output position; and output nozzle means situated at said output position for directing said stream of air in which said powder is suspended towards an object to be sprayed.

2. Apparatus according to claim 1 wherein the output nozzle means includes an electrically conductive surface which in use becomes charged to a high potential by contact with the powder to provide an electric field between the nozzle means and an object to be sprayed when such object is maintained at earth potential.

3. Apparatus according to claim 1 wherein the output nozzle means includes electrically insulating material.

4. Apparatus according to claim 3 wherein an electrode having a small radius of curvature, which in use is maintained at earth potential, is exposed at the inner surface of said nozzle means at a position remote from the outlet.

5. Apparatus according to claim 3 wherein said output nozzle means comprises an array of directional channels skewed relative to the axis of the output nozzle means.

6. Apparatus according to claim 1 wherein the triboelectric work function of the surface material of each of said blades is substantially different from that of said powder.

7. Apparatus according to claim 6 wherein the triboelectric work function of the inner surface material of said housing is substantially different from that of said powder.

8. Apparatus according to claim 6 wherein, when said powder is nylon, the surface material of each of said blades is metallic.

9. Apparatus according to claim 1 wherein said means for admitting powder to said housing includes means for maintaining the powder in a dry fluent state.

10. Apparatus according to claim 1 wherein said means for producing a stream of air through the housing comprises said rotor.

* * * * *